US005121514A

United States Patent [19]

Rosane

[11] Patent Number: 5,121,514

[45] Date of Patent: Jun. 16, 1992

[54] EMERGENCY SUPPORT DEVICE WITH FLEXIBLE POLYETHYLENE SHEET

[75] Inventor: Randy Rosane, Vancouver, Wash.

[73] Assignee: Lifeport, Inc., Vancouver, Wash.

[21] Appl. No.: 625,891

[22] Filed: Dec. 10, 1990

[51] Int. Cl.[5] ..... A61G 1/00; A61G 1/044; A61G 1/048

[52] U.S. Cl. ..... 5/628; 5/625; 128/870

[58] Field of Search ..... 5/82 R, 82 B; 7/81 R; 128/869, 870

[56] References Cited

U.S. PATENT DOCUMENTS

| | | | |
|---|---|---|---|
| 2,385,067 | 9/1945 | Egardner | 5/82 R |
| 2,788,530 | 4/1957 | Ferguson | 5/82 R |
| 2,899,692 | 8/1959 | Finken | 5/82 R |
| 3,151,343 | 10/1964 | McCormack | 5/82 R |
| 3,158,875 | 12/1964 | Fletcher | 5/82 R |
| 4,067,079 | 1/1978 | Buchman | 5/82 R |
| 4,124,908 | 11/1978 | Burns et al. | 5/82 R |
| 4,151,842 | 5/1979 | Miller | 5/82 B |
| 4,186,453 | 2/1980 | Burns et al. | 5/92 R |
| 4,601,075 | 7/1986 | Smith | 5/82 R |
| 4,627,428 | 12/1986 | Brooks | 5/82 R |
| 4,744,115 | 5/1988 | Marchione | 5/82 R |

*Primary Examiner*—Alexander Grosz
*Attorney, Agent, or Firm*—Knobbe, Martens, Olson & Bear

[57] ABSTRACT

This invention is an advancement in the safe and practical methods of transporting sick or injured patients. The Manhandler is a flexible stretcher constructed of pliable materials. The injured patient is firmly secured to the cot portion of the system by a flexible wrap of sturdy material that extends along each side of the patient's entire body and is secured across his body by a series of strong straps. The litter and the wrap are attached to two parallel flexible strips of material which form lifting grips. These side grips provide support when lifted from the side. A solid sheet of plastic material provides rigidity to the cot portion of the stretcher when side lift is applied, yet remains flexible to allow elevation of the feet and head when such lift is released. The supporting material is radio-opaque to allow x-rays without the necessity of removing the patient from the litter. The longitudinal movement of the patient is restrained, both by the securing straps and an additional stabilizing wrap at the foot of the stretcher. A bi-fold option of the stretcher is available which allows the cot portion of the system to be folded in half for use with children and smaller patients.

8 Claims, 3 Drawing Sheets

EMERGENCY SUPPORT DEVICE WITH FLEXIBLE POLYETHYLENE SHEET

BACKGROUND OF THE INVENTION

This invention relates to a safe, compact way to secure and transport injured or sick patients with the use of a lightweight stretcher which, while it retains its flexibility for ease in handling, also provides necessary rigidity to the weight-bearing portion of the stretcher when lifted from the side. The system is sturdy, yet easily stored when not in use.

Prior art stretchers for transporting injured or sick patients are generally heavy, bulky and mostly inflexible cots. See, for example, the rigid backboard disclosed in U.S. Pat. No. 4,151,842 to Miller. This type of prior art normally is constructed of wood, metal and/or heavy plastic and is space consuming to store when not in use. In addition, these traditional methods of transporting patients are inefficient as they frequently are difficult to manage in emergency situations. The inflexibility and weight of the standard stretcher can actually add to the difficulties in the transportation of injured or sick patients.

The principal current alternative support devices for transporting sick or injured patients are essentially nothing more than blankets with handles or support poles. U.S. Pat. Nos. 2,788,530 to Ferguson and 2,385,067 to Egardner are exemplary of the heavy canvas-type stretchers. The primary difficulty with the existing canvas-type devices for transporting sick or injured patients is that what is gained by increasing the flexibility of such systems is lost by a concurrent decrease in necessary rigidity in the weight-bearing portion of the stretcher. In addition, the cot portion of such alternative systems tends to excessively curl around the patient causing increased discomfort and risk of further injury to the patient.

Both classes of existing methods of moving sick and injured patients, the traditional rigid mechanical systems and the alternative inadequately supported systems, also have the problem of interfering with rapid radiological diagnosis of the patient.

SUMMARY OF THE INVENTION

There has been provided in accordance with the present invention an emergency support device for lifting and transporting a human patient while at the same time supporting and substantially immobilizing the patient. The support device comprises an axially elongate support layer extending along and providing support from beneath the patient. A first and a second flexible side wrap, flexibly secured along opposing longitudinal edges of the support layer are provided for extending along the sides of and at least partially across the top of the patient. A plurality of securing means such as straps are provided for securing the first and second side wraps snugly about the patient.

Preferably, an additional top layer and bottom layer are provided to surround the top and bottom respectively of the support layer.

Application of an upward lifting force along the longitudinal edges of the support layer causes a slight warping of the support layer across its transverse direction, thereby substantially increasing the axial rigidity of the support layer so as to provide support along the axial length of the patient.

Preferably, the first and second side wraps are integral with at least one of the top layer or bottom layer, and most preferably, the top layer and bottom layer and first and second side wraps comprise nylon sheeting.

A plurality of hand grips can also be provided along the longitudinal edges of the support layer, to facilitate carrying by emergency personnel. In addition, a plurality of loops can also be provided along the longitudinal edges of the support device, so that rigid poles may be inserted therethrough to facilitate carrying of the stretcher from the front and back instead of from the sides.

In accordance with another aspect of the present invention, the support layer comprises two or more coplanar, axially adjacent segments, secured within an envelope formed by a top layer and a bottom layer. The segmented support layer embodiment enables the support device to be folded into sections, to facilitate storage, transportation, or handling pediatric or infant patients.

In accordance with a further aspect of the present invention, the support device is provided with a radio opaque layer or coating, to facilitate such procedures as X-ray without the need to remove the patient from the support device.

Further objects, features, and advantages of the present invention will become apparent from the detailed description of preferred embodiments which follows, when considered together with the appended figures and claims.

DETAILED DESCRIPTION OF PREFERRED EMBODIMENTS

Figure 1:
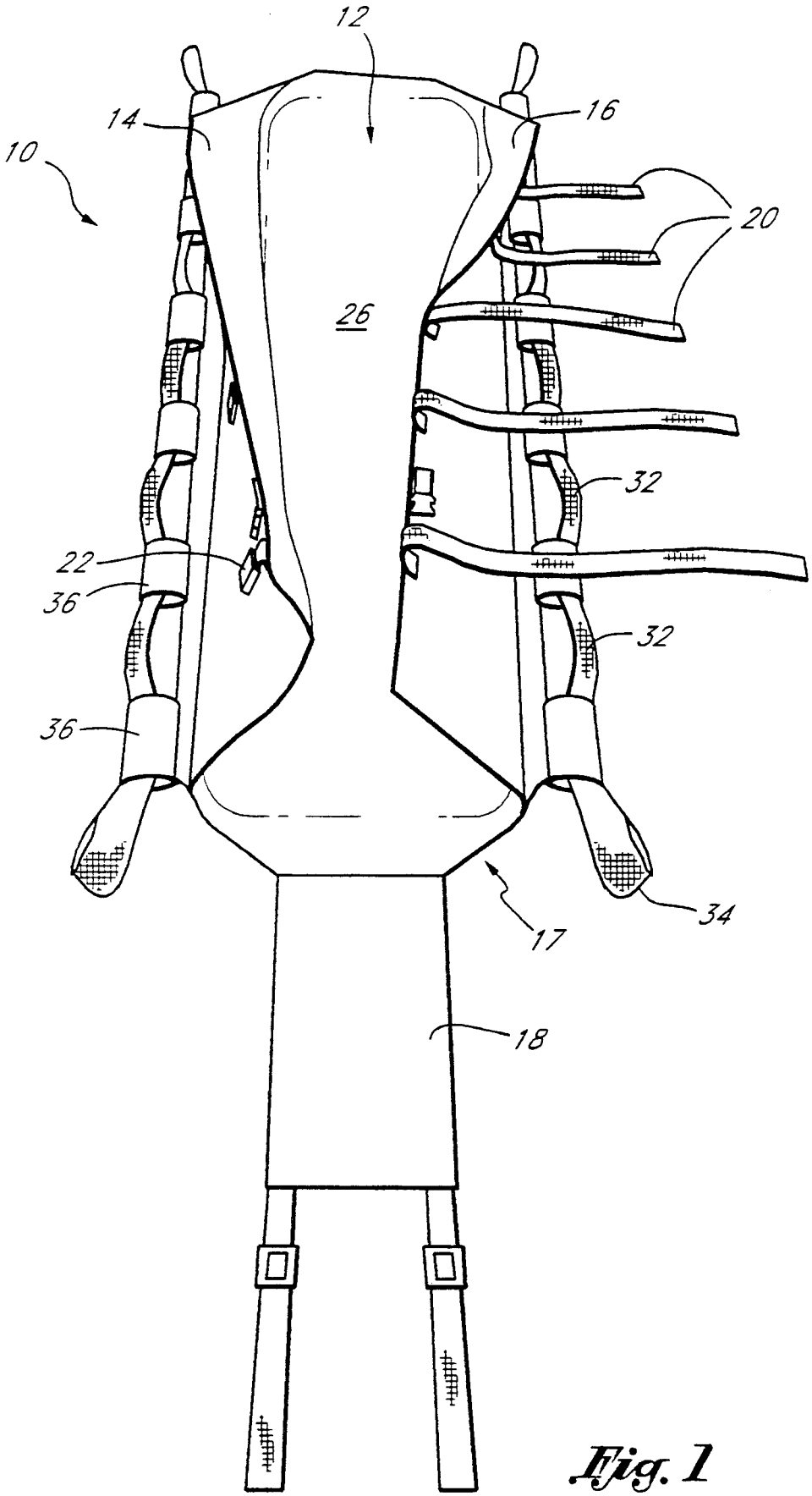
FIG. 1 is a perspective view of an unoccupied support device in accordance with the present invention.
Figure 2:
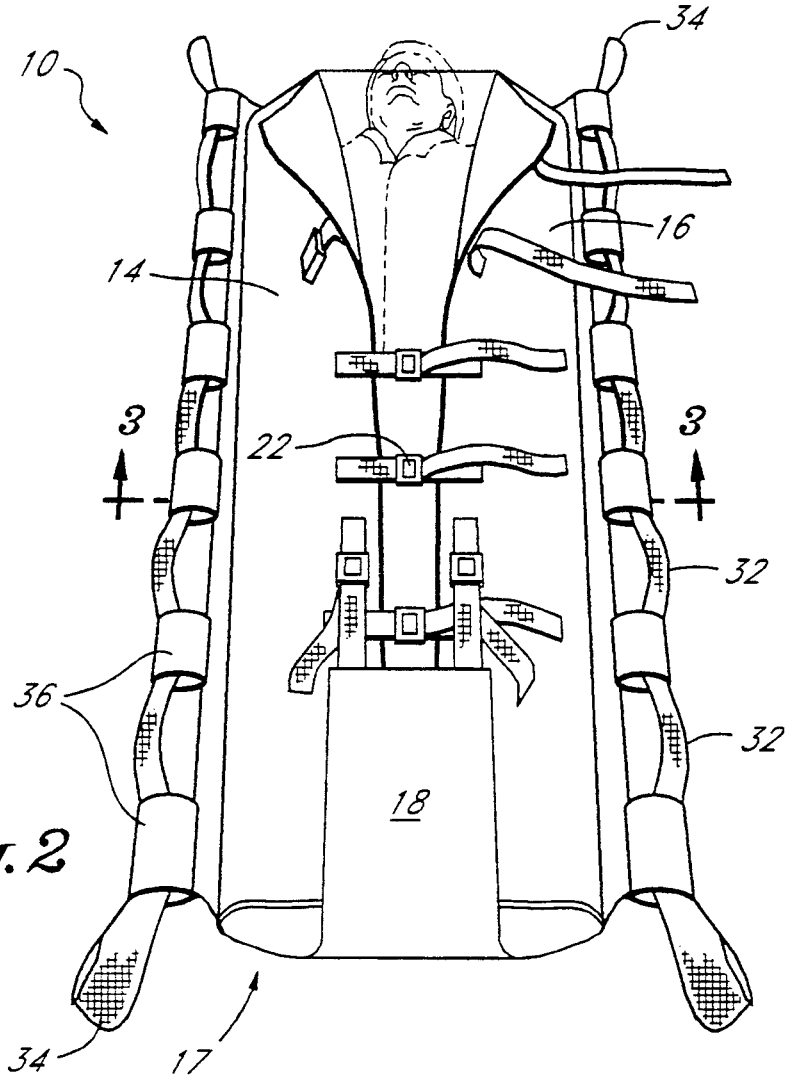
FIG. 2 is a perspective view as in FIG. 1, showing a patient therein.
Figure 3:
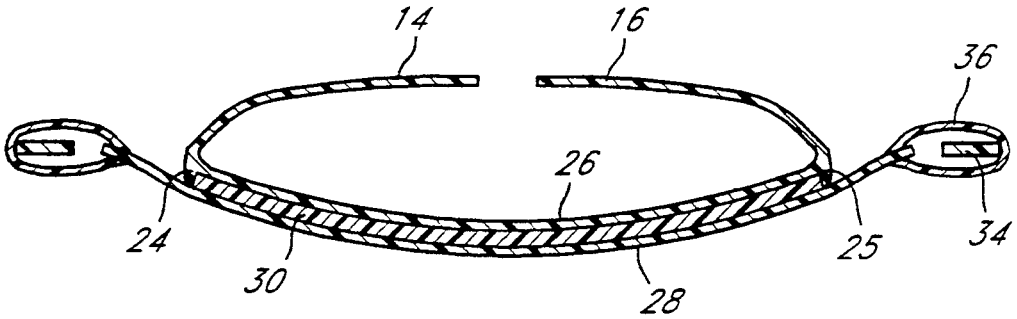
FIG. 3 is an elevational, cross-sectional view taken along the lines 3—3 on FIG. 2, across the transverse dimension of the support device.
Figure 4:
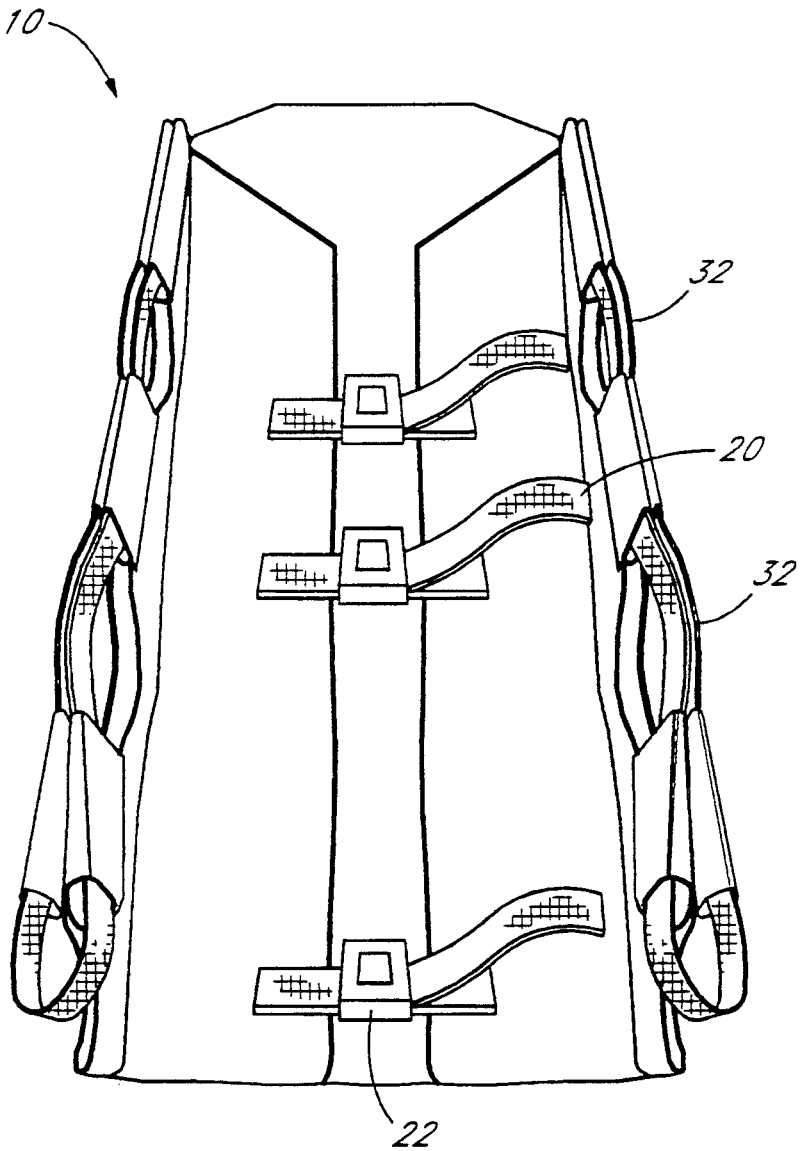
FIG. 4 is a perspective view of a support device in accordance with the present invention which has been folded in half for storage or for use with a small patient.

There has been provided in accordance with one aspect of the present invention a support device 10, comprising a cot portion 12 having flexible side wrap portions 14 and 16 secured along the opposing longitudinal edges thereof. Flexible side wraps 14 and 16 are for wrapping around the sides of and securing a patient to the cot 12. Preferably, foot wrap 18 is provided at the foot end 17 of the cot portion 12, for enclosing the feet of a patient. Foot wrap 18 is particularly desirable if the support device 10 encounters applications involving foot, leg or hip injuries where immobilization is important, or where vertical lifting, such as out of a mine shaft, may be necessary.

Side wraps 14 and 16 are secured about the body of a patient through the use of a plurality of straps 20 as is known in the art. Straps 20 preferably comprise a woven nylon or other lightweight, high strength material, and are securely stitched or otherwise fastened to the support device 10. Each of straps 20 is provided with a buckle 22 or other suitable fastening device for securely holding the side wraps 14 and 16 in position around the patient. In an embodiment which includes a foot wrap 18, straps may additionally be situated in a location to secure foot wrap 18 into position around the feet of the patient.

The wraparound restraint design of the side wraps 14, 16 of the present invention both restrains and secures the patient for his safety. The flexibility of the side wraps 14, 16 allows the extremities to be positioned and immobilized for emergency medical treatment such as intravenous infusion or blood pressure monitoring.

The restraint system when in use can secure the injured or sick patient much more safely than the traditional system of straps attached to the metal frame of the cot. The side wraps 14, 16, which preferably are part of the single unitized construction of the present invention, cover and restrain the extremities of the patient being transported. Splinted limbs may also be situated for comfort and access.

Cot portion 12 preferably comprises a top layer 26 and a bottom layer 28 which surround a support layer 30. When a patient is placed on the cot portion 12 and secured in position by way of side wraps 14 and 16, and preferably also foot wrap 18, the support device can then be carried by one or more persons on either side, such as by gripping any of a plurality of hand grips 32.

Hand grips 32 are conveniently formed by a length of nylon strapping 34 extending axially along opposing sides of the support device 10 and securely fastened such as by stitching to a plurality of loops 36. Loops 36 are adapted to receive a rigid pole along each side of the support device 10, which enables carrying the support device 10 from the ends if desired. In addition, the support device of the present invention may optionally be used with a backboard (not illustrated) to facilitate lifting of the patient.

When a patient is strapped securely into the support device 10 and it is picked up from the sides, the patient's weight causes the flexible support layer 30 to warp slightly from side to side. This imparts significant axial rigidity, thus providing good support along the axial length of the device. However, when the support device 10 is set down on a relatively flat surface and the side lift is eliminated, the support layer 30 resumes its normally substantially planar configuration and the axial rigidity dissipates.

Thus, the support layer 30 can be considered to have a longitudinal axis extending the length thereof and a substantially perpendicular transverse axis at any point along the longitudinal axis. From a substantially planar starting point, the support layer 30 can be alternately flexed along either axis. The load of a patient causes curvature along the transverse axis when the support layer 30 is lifted from the sides, thereby substantially preventing simultaneous curvature along the longitudinal axis under normal load conditions. The patient can then conveniently be carried by one or more persons on each side of the device.

When the device is set down on a reasonably planar surface, the transverse axis of the support layer will tend to resume its substantially linear configuration, again enabling curvature along the longitudinal axis. As a result, the head or the feet end of the support device 10 can then be elevated as desired for convenience or medical reasons.

Preferably, the support layer 30 comprises a unitary polymeric sheeting, such as polyethylene. In particular, LV832 available from Quantum Chemical Corp., 11500 Northlake Drive, Cincinatti, Ohio 45249 has been found to be particularly well suited for this purpose. Additional construction materials which accrue the advantages of the present invention can be determined through routine experimentation by one of skill in the art. The inherent flexibility under stress and thickness of the material used for support layer 30 are interrelated such that the support layer 30 will warp slightly from side to side under the weight of the patient, but will resist enveloping the patient to the point of imposing radially inwardly directed compression forces. Optimally, a relatively high strength plastic will be used so that the foregoing can be achieved while at the same time minimizing the overall bulk and weight of the support layer 30.

In one embodiment of the present invention, a unitary polyethylene sheeting of approximately 18 inches by 88 inches by ⅛ inch thick has been found to be useful for an adult size support structure. Other sizes and configurations of the support layer 30 can be utilized in accordance with the present invention, as will be understood by one of skill in the art. Suitable plastic sheeting can be obtained by extruding operations well known in the art.

Alternatively, the support layer 30 can be segmented into two or more coplanar axially aligned segments. Thus, for example, two polyethylene segments of substantially equal size can be positioned end to end within a top layer 26 and bottom layer 28 to provide a hinge point at the center of the support device. In this embodiment, a stitch or weld line preferably joins top layer 26 and bottom layer 28 in between the two segments. This can facilitate storage, and also conveniently enable pediatric or other small scale use of the support device.

The top layer 26 and bottom layer 28 can conveniently be formed from canvas, nylon, or any of a variety of other materials which will be well known in the art. Preferably, the material will be relatively lightweight, and waterproof so that it can be readily cleaned. In addition, a heat bondable or solvent bondable polymeric material may be useful from a manufacturing standpoint.

Preferably, the top layer 26 and bottom layer 28 merge on either side of the support layer 30 at a welded line 24 and 25, respectively. Weld lines 24 and 25 can be a heat or solvent bonded joint, or can be stitched as is well known in the art. In the illustrated embodiment, the side wraps 14 and 16 comprise an extension of the top layer 26 and/or bottom layer 28 past the weld lines 24 and 25. Thus, side wraps 14 and 16 are preferably integral with one or both of the top layer 26 and bottom layer 28.

The presently preferred material for top layer 26, bottom layer 28 and side wraps 14 and 16 is nylon sheeting such as Rhinotex available from Takashima Corp. U.S.A. Of the various ratings available, the 14 ounce Rhinotex sheeting, having a relatively low cold crack point of 45° below zero, is desirable for emergency use in cold climates. However, as will be understood by one of skill in the art, any of a variety of materials can be utilized as side wraps 14 and 16 which will accrue the advantages of the present invention.

Many of the difficulties of transporting injured or sick patients, particularly in emergency situations, can be minimized by utilizing current technology in sturdy, lightweight construction materials and incorporating that technology into the support device 10 of the present invention. The system provides firm support when lifted from the sides. When side support is not applied, the system is pliable for elevation of the head or feet. Traditional stretchers require mechanical manipulation to achieve the same effect.

The present invention further deals with the inefficiencies of traditional stretcher cots by allowing rescue and treating personnel to quickly reach the side of the patient in need with a stretcher and restraint system that can be transported easily.

As noted above, the principal current alternatives to the bulky, hard-to-manage traditional systems, are devices that have gained flexibility and maneuverability by sacrificing the supporting rigidity in the cot portion of the litter. This difficulty is resolved in the support device 10 of the present invention by the insertion of a recurved solid sheet of plastic in the cot portion 12 of the invention. The plastic insert is constructed in such a manner that when side lift is applied the sheet becomes axially rigid providing desirable support for the patient and at the same time retaining sufficient lateral rigidity to substantially prevent the protective cocoon from painfully constricting the patient. Optional rigid side lifting poles can be incorporated into the system to evenly distribute the lifting force.

The supporting solid plastic insert retains its flexibility when side lift is not applied, which allows easy elevation of the feet and head of the patient as desired without mechanical assistance or removing the patient from the stretcher The problem of the necessity of removing the patient from the stretcher for radiological diagnosis, thereby increasing risk of further injury and discomfort, may also be resolved by constructing the supporting plastic sheet of radio opaque material. Alternatively, an additional radio opaque layer or coating can be located in the cot portion 12 of the support device 10. Necessary x-rays may then be made without ever removing the patient from the stretcher.

Thus, the preferred embodiment of the invention is composed of a unitary flexible apparatus constructed of sturdy, pliable material. The cot portion 12 is securely fixed with respect to side grips 32, which are likewise composed of flexible material The same pliable material is used in side wraps 14 and 16, and foot wrap 18, which wrap over the body of the patient immobilizing and securing him to the stretcher utilizing straps 20 that pass over his body. The addition of a solid, recurved sheet of plastic in the cot portion 12 of the system provides rigidity of the cot when side lift is applied and which returns to normal flexibility is released. The radio-opaque quality of the plastic support allows for x-rays of the patient without removal from the transportation system.

In accordance with a further aspect of the present invention, there has been provided a method of lifting a patient, which comprises placing the patient on a support device having a flexible support layer 30 therein. An upward lifting force is thereafter applied to the longitudinal edges of the support device, which, together with the weight of the patient, causes the support layer 30 to flex slightly from side to side thereby imparting axial rigidity to the support layer. Removing the lift force allows the support layer to resume its normally substantially planar configuration, thereby enabling flexibility along the longitudinal axis of the device.

Although this invention has been described in terms of certain preferred embodiments, other embodiments that are apparent to those of ordinary skill in the art are also within the scope of this invention. Accordingly, the scope of the invention is intended to be defined only by reference to the appended claims.

What is claimed is:

1. An emergency support device for lifting and transporting a human patient while at the same time supporting and substantially immobilizing the patient, comprising:

an axially elongate unitary support layer made of a flexible sheet of polyethylene for extending along and providing support from beneath the patient, said support layer having a longitudinal axis and a transverse axis wherein said longitudinal axis extends the relatively longer length of the support layer and said transverse axis extends across the relatively shorter width of the support layer;

a top layer and a bottom layer surrounding the support layer and a first and second side wrap, each trap being integral with at least one of the top layer or bottom layer, each wrap extending along the sides of and at least partially across the top of the patient; and a plurality of straps for securely wrapping the side wraps around the patient;

wherein application of an upward lifting force along the longitudinal edges of the support layer substantially increases the axial rigidity of the support layer so as to provide support along the axial length thereof.

2. An emergency support device as in claim 1 further comprising a plurality of hand grips along the longitudinal edges of the support layer.

3. An emergency support device as in claim 1, wherein the support layer comprises at least two adjacent substantially coplanar segments.

4. A portable transportation system for movement of sick or injured patients consisting of a flexible stretcher with a restraint system composed of a top layer and a bottom layer and a first and second side wrap, each wrap being integral with at least one of the top layer or bottom layer, each wrap extending along the sides of and at least partially across the top of the patient, and a plurality of straps for securely wrapping the side wraps around the patient, and an elongated cot portion including a unitary flexible polyethylene support sheet having a longitudinal axis extending from head to toe along the length of the support sheet, and a transverse axis extending from side to side across the shorter dimension of the support sheet, said cot portion assuming axial rigidity with the application of lift with the side grips so that the longitudinal axis of the support sheet remains substantially linear and which resumes its axial flexibility when such lift is released.

5. A support device as defined in claim 4 in which the support layer in the cot portion is composed of a single solid sheet of material which assumes rigidity with the application of side lift.

6. A support device as defined in claims 4 or 5 in which the support layer in the cot portion is radioopaque.

7. An emergency support device for lifting and transporting a human patient while at the same time supporting and substantially immobilizing the patient, comprising:

an elongated, generally rectangular support layer made from a unitary flexible sheet of polyethylene and dimensioned for supporting a human patient in a supine position, said support layer having a longitudinal axis extending from a first end of the support layer to a second end of the support layer along the relatively longer dimensioned thereof, and a transverse axis extending generally perpendicularly to the longitudinal access, from a first side of the support layer to a second side of the support layer; such that in relation to said patient the longitudinal axis extends generally from head to toe, and the transverse axis extends generally from shoulder to shoulder of said patient;

said support layer being movable from a first position in which said support layer lies substantially within a plane, and a second position in which said first and second sides of said support layer are elevated above said plane such that said support layer in said second position generally defines a portion of the surface of a cylinder;

a top layer and a bottom layer surrounding the support layer and a first and second side wrap, each wrap being integral with at least one of the top layer or bottom layer, each wrap extending along the sides of and at least partially across the top of the patient, and a plurality of straps for securely wrapping the side wraps around the patient;

wherein application of an upward lifting force along the first and second sides of said support layer, when a patient is lying on said support layer, moves said support layer from said first position to said second position thereby causing said support layer to assume a configuration having an arcuate curvature from side to side while retaining substantial linearity from said first end to said second end along the longitudinal axis of the support layer.

8. An emergency support device as in claim 7, wherein said support layer is approximately $\frac{1}{8}$ inch thick.

* * * * *

UNITED STATES PATENT AND TRADEMARK OFFICE

CERTIFICATE OF CORRECTION

PATENT NO. : 5,121,514
DATED : June 16, 1992
INVENTOR(S) : Randy Rosane

It is certified that error appears in the above-indentified patent and that said Letters Patent is hereby corrected as shown below:

| | |
|---|---|
| Column 6 | Line 15, change "trap" to --wrap--; |
| Column 6 | Lines 55-56, change "radioopaque" to --radio-opaque--; |
| Column 6 | Line 67, change "dimensioned" to --dimension--. |

Signed and Sealed this

Twenty-sixth Day of April, 1994

*Attest:*

Bruce Lehman

BRUCE LEHMAN

*Attesting Officer*

*Commissioner of Patents and Trademarks*